US008152490B2

(12) United States Patent
Iguchi et al.

(10) Patent No.: US 8,152,490 B2
(45) Date of Patent: Apr. 10, 2012

(54) MOTOR DRIVEN COMPRESSOR

(75) Inventors: Masao Iguchi, Kariya (JP); Masahiro Kawaguchi, Kariya (JP); Ken Suitou, Kariya (JP); Hiroshi Fukasaku, Kariya (JP); Tatsushi Mori, Kariya (JP); Kazuo Murakami, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 671 days.

(21) Appl. No.: 12/334,025

(22) Filed: Dec. 12, 2008

(65) Prior Publication Data

US 2009/0151389 A1 Jun. 18, 2009

(30) Foreign Application Priority Data

Dec. 18, 2007 (JP) ..... P2007-326415

(51) Int. Cl.
*F04B 17/00* (2006.01)

(52) U.S. Cl. ..... 417/410.5; 417/410.1

(58) Field of Classification Search ..... 417/231, 417/366, 410.1–410.5, 367; 34/54, 58, 61
See application file for complete search history.

(56) References Cited

U.S. PATENT DOCUMENTS

| | | | | |
|---|---|---|---|---|
| 6,321,563 | B1 | 11/2001 | Ikeda et al. | 62/505 |
| 2001/0022939 | A1 | 9/2001 | Morita et al. | |
| 2002/0127118 | A1 | 9/2002 | Yokomachi et al. | |
| 2006/0083649 | A1 | 4/2006 | Makino et al. | |
| 2009/0148314 | A1 * | 6/2009 | Koitabashi et al. | 417/366 |

FOREIGN PATENT DOCUMENTS

| | | | |
|---|---|---|---|
| JP | 7-332266 | | 12/1995 |
| JP | 2001-263243 | A | 9/2001 |
| JP | 2002-266766 | A | 9/2002 |
| JP | 2004-218585 | | 8/2004 |
| JP | 2004-324494 | | 11/2004 |
| JP | 2006-177231 | A | 7/2006 |
| JP | 2006-207391 | A | 8/2006 |
| JP | 2006-348928 | A | 12/2006 |
| WO | WO 2006/106753 | A1 | 10/2006 |

OTHER PUBLICATIONS

English translation of first Office Action for Application No. 2008101866159, issued May 24, 2010.

* cited by examiner

*Primary Examiner* — Anne Hines
(74) *Attorney, Agent, or Firm* — Locke Lord LLP

(57) ABSTRACT

A motor-driven compressor has a compression mechanism, a rotary shaft, an electric motor, a motor drive circuit and a housing assembly. The compression mechanism, the electric motor and the motor drive circuit are disposed along the axial direction of the rotary shaft in the housing assembly. The housing assembly has first and second housings. The first housing mounts the electric motor and the compression mechanism. The first housing has first and second mounting lugs formed integrally with the peripheral surface of the first housing. The second housing is joined to the first housing for accommodating the motor drive circuit. The second housing has a third mounting lug formed integrally with the second housing. The first through third mounting lugs are fastened to a mounting object to which the motor-driven compressor is to be mounted by means of fastening members.

11 Claims, 2 Drawing Sheets

MOTOR DRIVEN COMPRESSOR

BACKGROUND OF THE INVENTION

The present invention relates to a motor-driven compressor having a compression mechanism, an electric motor, and a motor drive circuit which are disposed along the axial direction of a drive shaft of the compressor.

Such a motor-driven compressor used for a vehicle air conditioner or the like is disclosed in, for example, Japanese Patent Application Publication No. 2004-324494. The outer shell of the motor-driven compressor disclosed in the above reference includes a main housing and a front housing. The main housing is made of an aluminum alloy and formed in a cylindrical shape. The front housing is formed in the shape of a cover and connected to the front end of the main housing. The main housing of the motor-driven compressor accommodates therein an electric motor substantially at the center, a compression mechanism in the front, and a motor drive circuit in the rear. The electric motor has a stator fixed to the inner peripheral surface of the housing and a rotor mounted on the drive shaft inside of the stator. The compression mechanism is fixed to the inner peripheral surface of the main housing, and mounted on the drive shaft which is driven to rotate by the electric motor.

The motor-driven compressor is formed integrally at each of the top and bottom of its outer periphery with a pair of mounting lugs for mounting the motor-driven compressor on a vehicle engine (an object to which the motor-driven compressor is to be mounted). Specifically, the mounting lugs of each pair are spaced in the axial direction of the housing. Bolts (fastening members) are inserted through holes formed through the mounting lugs and screwed into bosses extending from the vehicle engine, so that the motor-driven compressor is mounted on the vehicle engine.

In the motor-driven compressor disclosed in the above reference, the mounting lugs of the main housing is formed at positions outside of the compression mechanism and the electric motor along the axial direction of the main housing. Since the mounting lugs are formed integrally with the main housing, the main housing may be deformed due to differences of the clamping forces of the bolts, poor dimensional accuracy of the bosses, and the like when the mounting lugs are fastened to the bosses by the bolts. As a result, the compression mechanism and the electric motor fixed to the main housing may be displaced out of alignment, and the rotary shaft is displaced out of axial alignment. This causes unwanted noise and deterioration of the durability of bearings supporting the rotary shaft.

The present invention is directed to providing a motor-driven compressor in which a first housing (main housing) can be prevented from being deformed by fastening of the mounting lugs to an object to which the motor-driven compressor is to be mounted by means of fastening members.

SUMMARY OF THE INVENTION

In accordance with the present invention, a motor-driven compressor has a compression mechanism, a rotary shaft, an electric motor, a motor drive circuit and a housing assembly. The compression mechanism compresses a refrigerant gas. The rotary shaft rotates to drive the compression mechanism. The electric motor is connected to the rotary shaft. The motor drive circuit is used for driving the electric motor. The compression mechanism, the electric motor and the motor drive circuit are disposed along the axial direction of the rotary shaft in the housing assembly. The housing assembly has a first housing for mounting the electric motor and the compression mechanism. The first housing has first and second mounting lugs formed integrally with the peripheral surface of the first housing on the radially opposite sides of the rotary shaft. The second housing is joined to the first housing for accommodating the motor drive circuit. The second housing has a third mounting lug formed integrally with the second housing. The first through third mounting lugs are fastenable to a mounting object on which the motor-driven compressor is to be mounted by means of fastening members.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
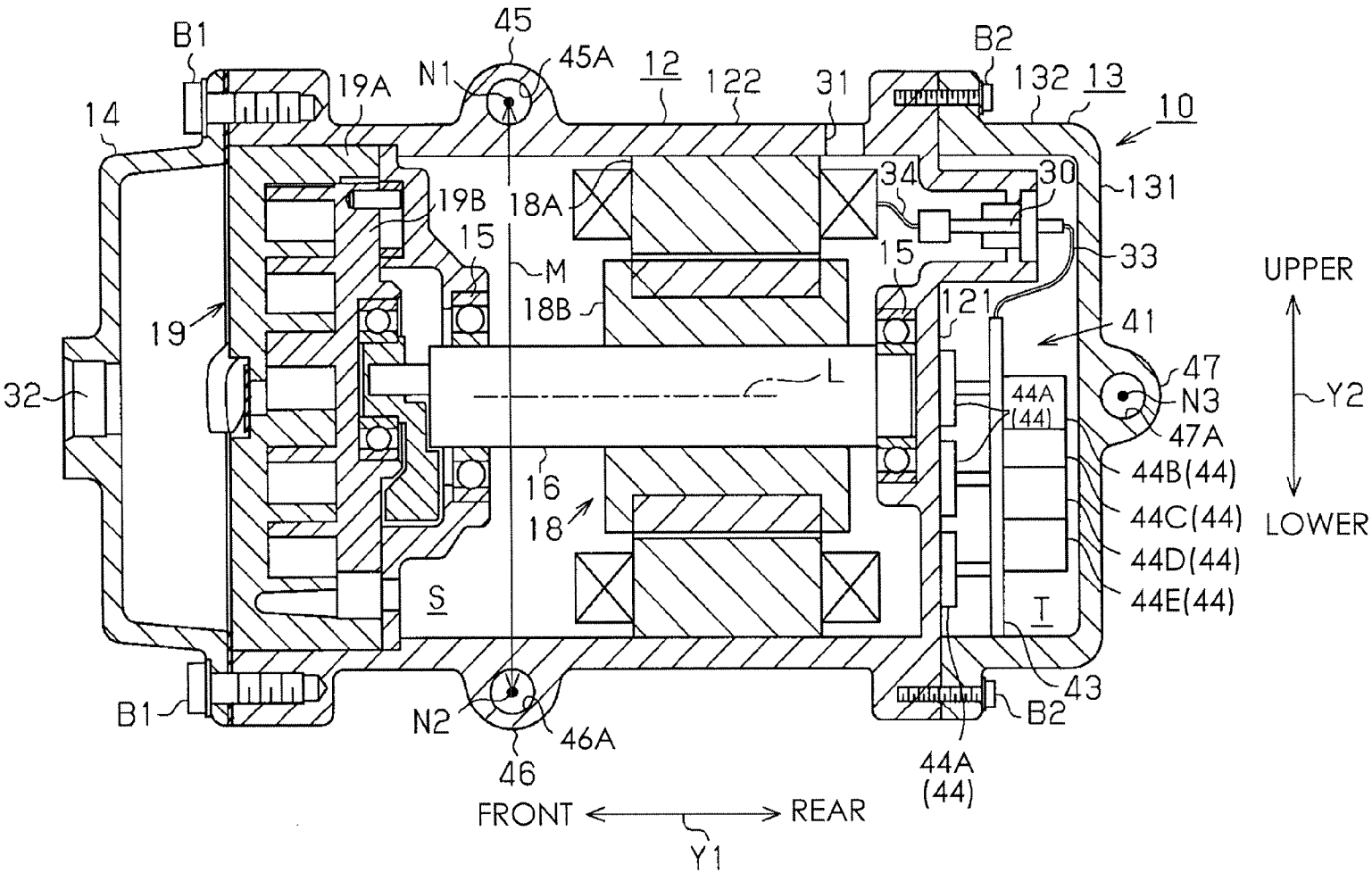
FIG. 1 is a longitudinal cross-sectional view of a motor-driven compressor according to a preferred embodiment of the present invention.
Figure 2:
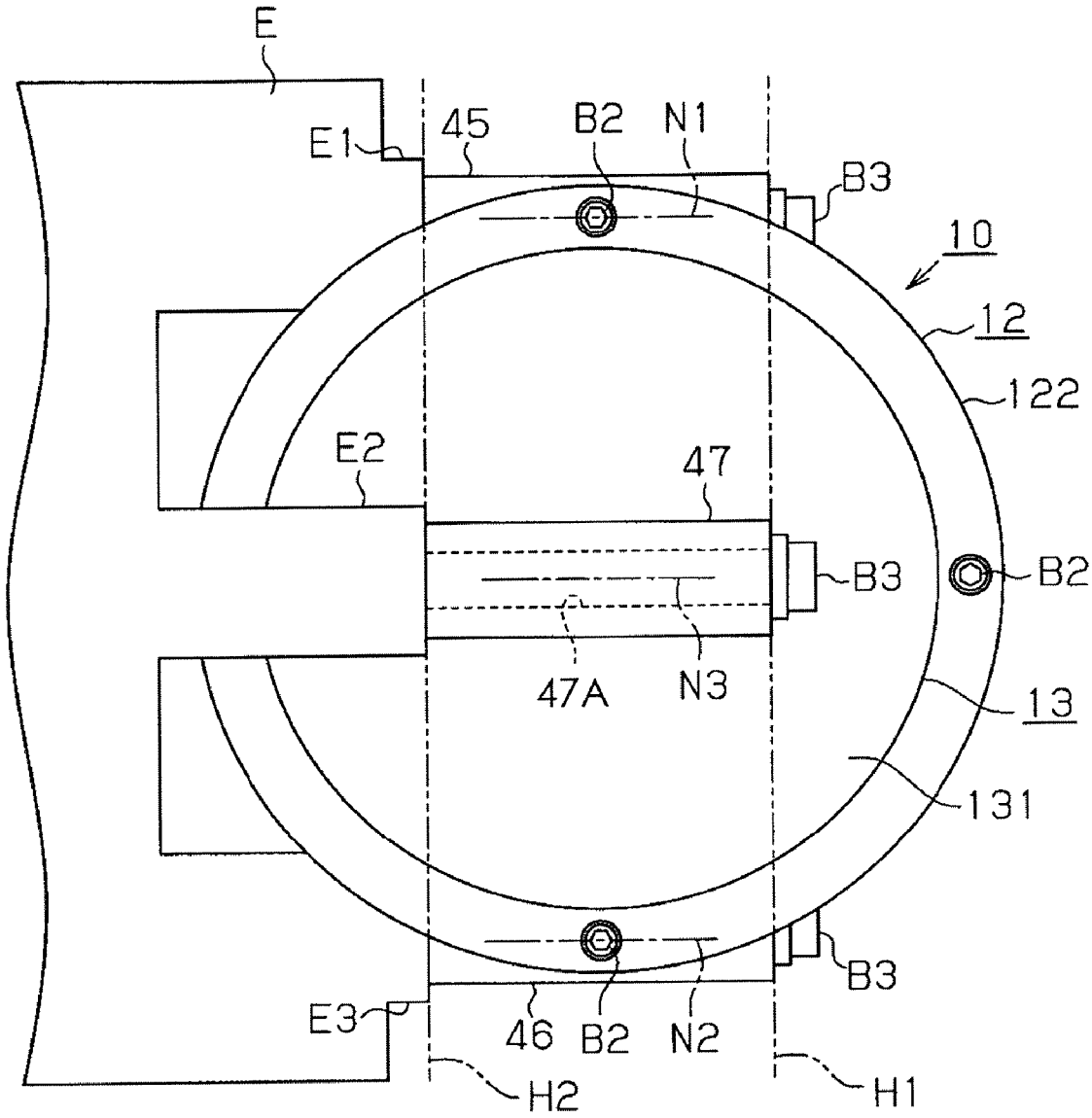
FIG. 2 is an illustrative view showing the motor-driven compressor of FIG. 1 as mounted on a vehicle engine.

The following will describe the preferred embodiment with reference to FIGS. 1 and 2, in which the present invention is applied to a motor-driven compressor mounted on a hybrid vehicle and used for a vehicle air conditioner. The front and rear sides of the motor-driven compressor as will be referred to in the following description are indicated by the double-headed arrow Y1 in FIG. 1. The upper and lower sides of the motor-driven compressor are indicated by the double-headed arrow Y2 in FIG. 1.

Referring to FIG. 1, the motor-driven compressor generally designated by reference numeral 10 has a housing assembly including a first housing 12, a second housing 13 and a third hosing 14. Major part of the housing assembly is formed by the first housing 12. As shown in FIG. 1, the second housing 13 is connected to the rear end of the first housing 12, and the third housing 14 is connected to the front end of the first housing 12. The first housing 12 is made of a die-cast aluminum alloy, and has a cylindrical shape with one end closed. Specifically, the first housing 12 includes a rear wall portion 121 and a cylindrical wall portion 122 extending from the entire periphery of the rear wall portion 121. The second housing 13 is also made of a die-cast aluminum alloy, and has a cylindrical shape with one end closed. Specifically, the second housing 13 includes a cover portion 131 and a cylindrical wall portion 132 extending from the entire periphery of the cover portion 131. The third housing 14 is also made of a die-cast aluminum alloy and has a cylindrical shape with front end closed.

The first housing 12 and the second housing 13 are fastened together by means of four second bolts B2 (only two second bolts B2 is shown in FIG. 1), and the first housing 12 and the third housing 14 are fastened together by means of four first bolts B1 (only two first bolts B1 is shown in FIG. 1).

The first housing 12 and the third housing 14 collectively define therebetween a closed space S, in which the rotary shaft 16 is rotatably supported by bearings 15 disposed in the front and rear of the first housing 12. Reference symbol L in FIG. 1 indicates the central axis of the rotary shaft 16, and the direction of the central axis L corresponds to the axial direction of the first housing 12 and hence of the motor-driven compressor 10. The first housing 12 is arranged in the motor-driven compressor 10 such that the cylindrical wall portion 122 thereof surrounds the rotary shaft 16 and the central axis L.

The first housing 12 has therein an electric motor 18 and a compression mechanism 19 which are fixedly mounted thereon. The electric motor 18 has a stator 18A fixed to the inner peripheral surface of the cylindrical wall portion 122 of the first housing 12 and a rotor 18B mounted on the rotary shaft 16 of the first housing 12 inside of the stator 18A. Electrical power is supplied to the stator 18A, and the electric motor 18 drives to rotate the rotary shaft 16.

The compression mechanism 19 is of a scroll type, having a fixed scroll 19A and a movable scroll 19B. The movable scroll 19B orbits around the fixed scroll 19A in accordance with the rotation of the rotary shaft 16, and the compression mechanism 19 compresses refrigerant gas. In operation of the compressor, the electric motor 18 drives to rotate the rotary shaft 16, which in turn drives the compression mechanism 19. Refrigerant gas in an external refrigerant circuit (not shown) under a relatively low temperature and low pressure is suctioned into the closed space S through a suction port 31 formed through the first housing 12. Then refrigerant gas is flowed through the electric motor 18, and then into the compression mechanism 19. Subsequently, refrigerant gas is compressed by the compression mechanism 19, and the refrigerant gas compressed into a high temperature and high pressure gas is discharged to the external refrigerant circuit through a discharge port 32 formed through the third housing 14. The configuration of allowing the refrigerant gas flowing from the external refrigerant circuit and having relatively low temperature to flow through the electric motor 18 in the closed space S before being introduced into the compression mechanism 19 is to cool both the electric motor 18 and a motor drive circuit 41 which will be described later.

The rear wall portion 121 of the first housing 12 and the second housing 13 cooperate to define therebetween an accommodation space T for accommodating therein the motor drive circuit 41. In other words, the accommodation space T is defined by rear end surface of the rear wall portion 121 of the first housing 12 and the inner peripheral surface of the second housing 13. The accommodation space T has therein the motor drive circuit 41 which is used for driving the electric motor 18. The motor drive circuit 41 serving as an inverter supplies electrical power to the stator 18A of the electric motor 18 in response to control signals from an electrical control unit (ECU) of the vehicle air conditioner (not shown).

The motor drive circuit 41 has a plate-like circuit board 43 and various kinds of electronic components 44 mounted on the circuit board 43. Reference numeral 44 generally indicates various electronic components 44A through 44E which will be described later, and other related components (not shown). As shown in FIG. 1, the electronic components 44 include known electronic components 44A through 44E for inverter such as switching devices 44A, and an electrolytic capacitor 44B, a transformer 44C, a driver IC 44D, a resistor 44E, and the like. The switching devices 44A are mounted on the front side of the circuit board 43 adjacent to the first housing 12. The switching devices 44A are provided with the front side surface thereof adjacent to the first housing 12 set in contact with the first housing 12. Thus, the refrigerant gas flowing in the closed space S under a relatively low temperature cools the rear wall portion 121, thereby helping to cool the switching devices 44A.

The first housing 12 has a connecting terminal 30 fixed to the rear wall portion 121 of the first housing 12. The connecting terminal 30 is electrically connected at one end thereof to the circuit board 43 and at the other end thereof to the stator 18A through lead wires 33, 34, respectively. As shown in FIG. 1, the compression mechanism 19, the electric motor 18 and the motor drive circuit 41 are disposed in the housing assembly of the motor-driven compressor 10 in this order along the axial direction of the rotary shaft 16.

The housing assembly of the motor-driven compressor 10 is formed with a first mounting lug 45, a second mounting lug 46 and a third mounting lug 47 for mounting the motor-driven compressor 10 to a hybrid vehicle engine E. The hybrid vehicle engine E is an object on which the motor-driven compressor 10 is to be mounted. The first mounting lug 45 is formed integrally with the first housing 12 at the top outer peripheral surface of the cylindrical wall portion 122 thereof, and formed in an elongated cylindrical shape perpendicular to the central axis L of the rotary shaft 16. The first mounting lug 45 has a first hole 45A formed therethrough perpendicular to the central axis L of the rotary shaft 16. The second mounting lug 46 is formed integrally with the first housing 12 at the bottom outer peripheral surface of the cylindrical wall portion 122 thereof, and formed in an elongated cylindrical shape extending perpendicular to the central axis L of the rotary shaft 16. The second mounting lug 46 has a second hole 46A formed therethrough perpendicular to the central axis L of the rotary shaft 16.

Referring to FIG. 2, the first and second mounting lugs 45, 46 are formed on the opposite top and bottom sides of the first housing 12 as seen from the rotary shaft 16, and extend with the central axes N1, N2 thereof in parallel to each other. The first and second mounting lugs 45, 46 are formed with the same length as measured in a direction of the central axes N1, N2. The right end surfaces of the first and second mounting lugs 45, 46 as seen in FIG. 2 are located in a virtual plane H1, and the opposite left end surface thereof are located in a virtual plane H2. Referring to FIG. 1, the first and second mounting lugs 45, 46 are provided on the cylindrical wall portion 122 of the first housing 12 at a position between the electric motor 18 and the compression mechanism 19 as seen in the axial direction of the first housing 12. Thus, the first and the second mounting lugs 45, 46 are located on the radially opposite top and bottom sides of the first housing 12 or the cylindrical wall portion 122 as seen from the rotary shaft 16.

The third mounting lug 47 is formed integrally with the second housing 13 at the center of the outer surface of the cover portion 131 thereof, and formed into an elongated cylindrical shape extending perpendicular to the central axis L of the rotary shaft 16. The third mounting lug 47 has a third hole 47A formed therethrough extending perpendicular to the central axis L of the rotary shaft 16. The third mounting lug 47 is provided in the second housing 13 at a position furthest from the compression mechanism 19 in the axial direction of the first housing 12. Reference symbol M in FIG. 1 indicates the distance between the central axis N1 of the first mounting lug 45 and the central axis N2 of the second mounting lug 46. The axis N3 of the third mounting lug 47 is vertically located at the middle point of the distance M, as well as at the central axis L of the rotary shaft 16.

Referring to FIG. 2, the third mounting lug 47 is formed in the second housing 13 such that the central axis N3 thereof is in parallel relation to the central axes N1, N2 of the first and second mounting lugs 45, 46. The first, second and third mounting lugs 45, 46, 47 have the same length as measured in the extending direction of the central axes N1, N2, N3 thereof. The first, second and third mounting lugs 45, 46, 47 are formed with the right end surface thereof as seen in FIG. 2 located in the virtual plane H1, and the left end surface thereof located in the virtual plane H2, respectively.

Third bolts B3 serving as a fastening member are inserted through the respective holes 45A, 46A, 47A of the first, second and third mounting lugs 45, 46, 47 and screwed into the bosses E1, E2, E3 formed in the vehicle engine E, respectively. Thus, the electric-motor compressor 10 is mounted on a side surface of the vehicle engine E.

According to the preferred embodiment, the following advantageous results are obtained.

(1) The first and second mounting lugs 45, 46 are formed integrally with the first housing 12 on the radially opposite top and bottom sides of the first housing 12 as seen from the rotary shaft 16. The third mounting lug 47 is formed integrally with the second housing 13 that is separated from the first housing 12. Stress is generated in the motor-driven compressor 10 at a plurality of points in the axial direction thereof by screwing the third bolts B3 into the bosses E1, E2, E3. However, because the first and second housing lugs 45, 46 are located at same points in the axial direction on the first housing 12, and the third mounting lug 47 is on the different housing from the first housing 12, stress is hardly generated at a plurality of points in the axial direction of the first housing 12 by screwing the third bolts B3 for fastening. Thus, the first housing 12 may be prevented from deformation caused by fastening the first, second, third mounting lugs 45, 46, 47 to the bosses E1, E2, E3 by the third bolts B3. Therefore, the electric motor 18 and the compression mechanism 19 in the first housing 12 may be prevented from being displaced out of alignment, and the rotary shaft may be prevented from being displaced out of axial alignment. As a result, unwanted noise may be prevented from being generated due to the displacement of the rotary shaft 16, and the durability of the bearing 15 supporting the rotary shaft 16 may be maintained.

(2) The second housing 13 has a cylindrical shape with one end closed, and the third mounting lug 47 is formed integrally with the cover portion 131 of the second housing 13. Thus, the rigidity of the cover portion 131 may be improved by the third mounting lug 47 and, therefore, the motor drive circuit 41 may be protected by the second housing 13 reliably.

(3) The second housing 13 is connected to the rear end of the first housing 12, and the third mounting lug 47 is formed integrally with the second housing 13. The third mounting lug 47 is provided at the position of the motor-driven compressor 10 furthest from the compression mechanism 19 which vibrates most strongly in the motor-driven compressor 10. The vibration generated in the compression mechanism 19 is less transmitted to the vehicle engine E through the third bolts B3 in comparison with a structure in which all of the first, second, third mounting lugs 45, 46, 47 are formed integrally with the first housing 12. Thus, in operation of a hybrid vehicle when an electric motor is being driven for driving the vehicle during the vehicle engine E being stopped, vibration generated in the motor-driven compressor 10 is hardly transmitted to the vehicle engine E. Therefore, the vibration of the motor-driven compressor 10 may be prevented from being transmitted to the compartment of the vehicle.

(4) The motor-driven compressor 10 provided with three mounting lugs 45, 46, 47 is advantageous in terms of material cost of the motor-driven compressor in comparison with the structure of the prior art in which four mounting lugs are provided in the compressor.

(5) Only one mounting lug, which is the third mounting lug 47, is provided in the second housing 13. Thus, the second housing 13 is easy to manufacture, and the motor-driven compressor 10 with such second housing 13 is easy to be arranged in an engine room of a vehicle in comparison with a structure in which two or more mounting lugs are provided in the second housing.

(6) The first and second mounting lugs 45, 46 are formed integrally with the first housing 12 at positions thereof where the first and second mounting lugs 45, 46 are not lapped over the electric motor 18 and the compression mechanism 19 with respect to the axial direction of the rotary shaft 16. Thus, the electric motor 18 and the compression mechanism 19 may be prevented from being displaced out of alignment due to fastening of the first and second mounting lugs 45, 46 to the first and second bosses E1, E2 by means of the third bolts B3.

The above preferred embodiment may be modified as follows.

The electric motor 18, the compression mechanism 19 and the motor drive circuit 41 may be arranged along the axial direction of the rotary shaft 16 in this order in the housing assembly of the motor-driven compressor 10.

Two or more mounting lugs may be provided in the second housing 13.

The third mounting lug 47 may be formed integrally with the wall portion 132 of the second housing 13.

In the above preferred embodiment, bolts are used as a fastening member. However, the fastening member is not limited to the bolts, but any other fastening members such as screws are acceptable.

The compression mechanism 19 is not limited to a scroll type, but it may be of a piston type or a vane type.

In the above preferred embodiment, the motor-driven compressor 10 is installed on a hybrid vehicle. Alternatively, the motor-driven compressor 10 may be installed on a vehicle powered solely by an engine.

The motor-driven compressor 10 of the above preferred embodiment has been described as applied to a vehicle air conditioner. Alternatively, the motor-driven compressor 10 may be used for an air conditioner for applications other than vehicles.

In the preferred embodiment, the motor-driven compressor 10 is connected to the vehicle engine E as an object on which the motor-driven compressor 10 is to be mounted. Alternatively, the motor-driven compressor 10 may be connected to a body forming an engine room of a hybrid vehicle as the object.

The present examples and embodiments are to be considered as illustrative and not restrictive, and the invention is not to be limited to the details given herein but may be modified within the scope of the appended claims.

What is claimed is:

1. A motor-driven compressor comprising:

a compression mechanism compressing a refrigerant gas;

a rotary shaft rotating to drive the compression mechanism;

an electric motor connected to the rotary shaft;

a motor drive circuit for driving the electric motor; and a housing assembly in which the compression mechanism, the electric motor and the motor drive circuit are disposed along the axial direction of the rotary shaft, the housing assembly having:

a first housing for mounting the electric motor and the compression mechanism, the first housing having first and second mounting lugs formed integrally with the peripheral surface of the first housing; and a second housing joined to the first housing for accommodating the motor drive circuit, the second housing having a third mounting lug formed integrally with the second housing, wherein the first through third mounting lugs are fastenable to a mounting object on which the motor-driven compressor is to be mounted by means of fastening members, the first and second mounting lugs are located between the electric motor and the compression mechanism in the axial direction of the peripheral surface of the first housing, and the first and second mounting lugs are formed integrally with the first housing at positions of the first housing where the first and second mounting lugs are not lapped over the electric motor and the compression mechanism.

2. The motor-driven compressor according to claim 1, wherein the first through third mounting lugs extend perpendicular to the axial direction of the rotary shaft.

3. The motor-driven compressor according to claim 1, wherein the first through third mounting lugs have a hole formed therethrough extending perpendicular to the axial direction of the rotary shaft.

4. The motor-driven compressor according to claim 1, wherein the second housing has a cylindrical shape with one end closed, and includes a cover portion and a cylindrical wall portion extending from the entire periphery of the cover portion.

5. The motor-driven compressor according to claim 4, wherein the third mounting lug is formed integrally with the cover portion.

6. The motor-driven compressor according to claim 1, wherein the third mounting lug is disposed along the axial direction of the rotary shaft and on the opposite side of the compression mechanism.

7. The motor-driven compressor according to claim 1, wherein the compression mechanism, the electric motor, and the motor drive circuit are disposed in the housing assembly in this order.

8. The motor-driven compressor according to claim 1, wherein the mounting object on which the motor-driven compressor is to be mounted is an engine.

9. The motor-driven compressor according to claim 1, wherein the rotary shaft is rotatably supported by bearings disposed in the front and rear of the first housing.

10. The motor-driven compressor according to claim 1, wherein the mounting lug formed integrally with the first housing is only the first and second mounting lugs.

11. The motor-driven compressor according to claim 1, wherein the first and second mounting lugs are disposed on the radially opposite sides of the rotary shaft.

* * * * *